US008526273B2

(12) United States Patent
Gordon et al.

(10) Patent No.: US 8,526,273 B2
(45) **Date of Patent: *Sep. 3, 2013**

(54) TIME INTERVAL INDICATING DEVICE

(75) Inventors: Gayle E. Gordon, Naperville, IL (US); Ng Kwok-ho Victor, Kowloon (HK)

(73) Assignee: Learning Resources, Inc., Vernon Hills, IL (US)

( * ) Notice: Subject to any disclaimer, the term of this patent is extended or adjusted under 35 U.S.C. 154(b) by 139 days.

This patent is subject to a terminal disclaimer.

(21) Appl. No.: 13/277,714

(22) Filed: Oct. 20, 2011

(65) Prior Publication Data

US 2012/0033532 A1 Feb. 9, 2012

Related U.S. Application Data

(63) Continuation of application No. 12/789,218, filed on May 27, 2010, now Pat. No. 8,072,846, which is a continuation of application No. 11/015,834, filed on Dec. 17, 2004, now Pat. No. 7,729,206.

(51) Int. Cl.
*G04C 19/00* (2006.01)

(52) U.S. Cl.
USPC ..... 368/109; 368/79

(58) Field of Classification Search
USPC ..... 368/89, 107–109
See application file for complete search history.

(56) References Cited

U.S. PATENT DOCUMENTS

| | | | | |
|---|---|---|---|---|
| 3,744,235 | A | | 7/1973 | Kratomi |
| 4,167,001 | A | | 9/1979 | Gilmore |
| 4,505,595 | A | | 3/1985 | Rose et al. |
| 4,995,018 | A | | 2/1991 | Edwards |
| 5,088,056 | A | | 2/1992 | McIntosh et al. |
| 5,140,564 | A | | 8/1992 | Rich |
| 5,140,654 | A | | 8/1992 | Akasaka et al. |
| 5,253,228 | A | * | 10/1993 | Truett ..... 368/82 |
| 5,325,340 | A | * | 6/1994 | Ramsey ..... 368/3 |
| D352,668 | S | | 11/1994 | Peersmann |
| 5,365,495 | A | | 11/1994 | Cussen |
| 5,469,346 | A | | 11/1995 | Haut et al. |
| 5,662,479 | A | | 9/1997 | Rogers |
| 5,708,629 | A | | 1/1998 | Hung-Hsu |
| 5,796,681 | A | | 8/1998 | Aronzo |
| 5,854,774 | A | | 12/1998 | Timme |
| 6,326,883 | B1 | | 12/2001 | Whitehead et al. |
| D458,155 | S | | 6/2002 | Stekelenburg |
| 6,483,439 | B1 | | 11/2002 | Vukosic |

FOREIGN PATENT DOCUMENTS

| | | |
|---|---|---|
| GB | 2196156 | 4/1988 |
| JP | 9-33671 | 2/1997 |

* cited by examiner

*Primary Examiner* — Sean Kayes
(74) *Attorney, Agent, or Firm* — Michael Best & Friedrich LLP

(57) ABSTRACT

A device for indicating the passage of two or more time intervals is provided. In one embodiment, the device includes a base portion with a user interface and a light portion. The light portion includes three lights of different colors that are disposed in a vertical arrangement above the base portion. The user interface includes a display and a keypad for programming the device with one or more time durations, and for associating one or more of the lights with each time interval. A controller is in communication with the user interface and operatively coupled with the lights to illuminate and turn off each light during its associated interval. The device may include an audio section linked to the controller for further indicating the intervals or transitions therebetween by outputting one or more sounds.

7 Claims, 8 Drawing Sheets

TIME INTERVAL INDICATING DEVICE

CROSS-REFERENCE TO RELATED APPLICATIONS

This is a continuation of co-pending U.S. patent application Ser. No. 12/789,218, filed May 27, 2010, which is a continuation of U.S. patent application Ser. No. 11/015,834 (U.S. Pat. No. 7,729,206), filed Dec. 17, 2004. The entire contents of both of these applications are hereby incorporated by reference.

FIELD OF THE INVENTION

This invention generally pertains to timing devices, and more particularly to a device for indicating the passage of time intervals.

BACKGROUND OF THE INVENTION

Various devices are known in the art for timing events. Timers may be categorized in one of two groups as either an incremental (i.e., count-up) or decremental (i.e., count-down) device. Various mechanical, electro-mechanical, and electrical clocks or stopwatches have been employed to tell time and/or time activities and events in a count-up manner. Such count-up devices typically provide a visual indication using hands or numerals for designating the hour, minute and second of the time of day or elapsed time of the activity. Although the foregoing count-up devices are often useful for telling the time of day and for timing simple events such as a race by use of a simple "lap" time functionality, such devices are not well suited for providing an indication of the time remaining in an activity.

Count-down devices are best suited to management of remaining time. Count-down devices include hourglasses filled with sand, egg timers and timers on microwaves and ovens that ring or buzz when time has expired. Such devices are useful for timing activities, such as taking a test, and assisting with time management where the instant of time expiration is focal. However, such count-down devices do not typically provide a clear indication of an individual's progress in an activity since the devices often require an event participant to calculate, interpret or judge how much time is remaining in the active interval and estimate or extrapolate his or her progress relative to the total length of the activity. Moreover, such devices place a particular importance on the instant of time expiration by providing a single audible or visual signal, and they are not well-suited for use with activities having multiple steps or intervals or providing a gentle and/or progressive warning for assisting a participant of an activity with his or her time management.

Further, interpretation of the foregoing count-up and count-down devices may be hindered by the fact that these devices typically must be viewed close up as they are not easily viewable from a distance, particularly if a plurality of participants are involved in the activity or event. In a further example, if the activity or environment is noisy, a conventional timer that sounds a warning may not be well-suited to the activity since the warning may not be heard by the participants. To that end a visual indication such as a light or combination indication such as a light and sound would be helpful. Additionally, such devices primarily rely on visual or aural interpretation of the device and therefore preclude the participation of an individual who is visually or hearing impaired or who is at a great distance from the timing device. For example, in a classroom where students are engaged in a time-delimited activity like small group time or free time, the teacher may want to warn the students in several areas of the classroom simultaneously of the approaching end of the activity and to start cleaning up. For certain tasks, it is desirable to give a gentle or progressive warning that the deadline is approaching, and clocks do not provide such a warning. Therefore, in view of the foregoing, a time interval indicating device providing visual and audible cues for timing activities or events including two or more intervals would be welcomed.

BRIEF SUMMARY OF THE INVENTION

A device for indicating the passage of two or more time intervals is provided. In the illustrated embodiment, the device includes a base portion with a user interface and a light portion. The light portion includes two or more lights, which may be of different colors, disposed in a vertical arrangement above the base portion. The user interface includes a display and a keypad for programming the device with one or more time durations, and for associating one or more of the lights with each time interval. A controller is in communication with the user interface and operatively coupled with the lights to illuminate each light during its associated interval. The device may include an audio section linked to the controller for further indicating the intervals or transitions therebetween by outputting one or more audio signal.

DETAILED DESCRIPTION OF THE EXEMPLARY EMBODIMENTS

Figure 1:
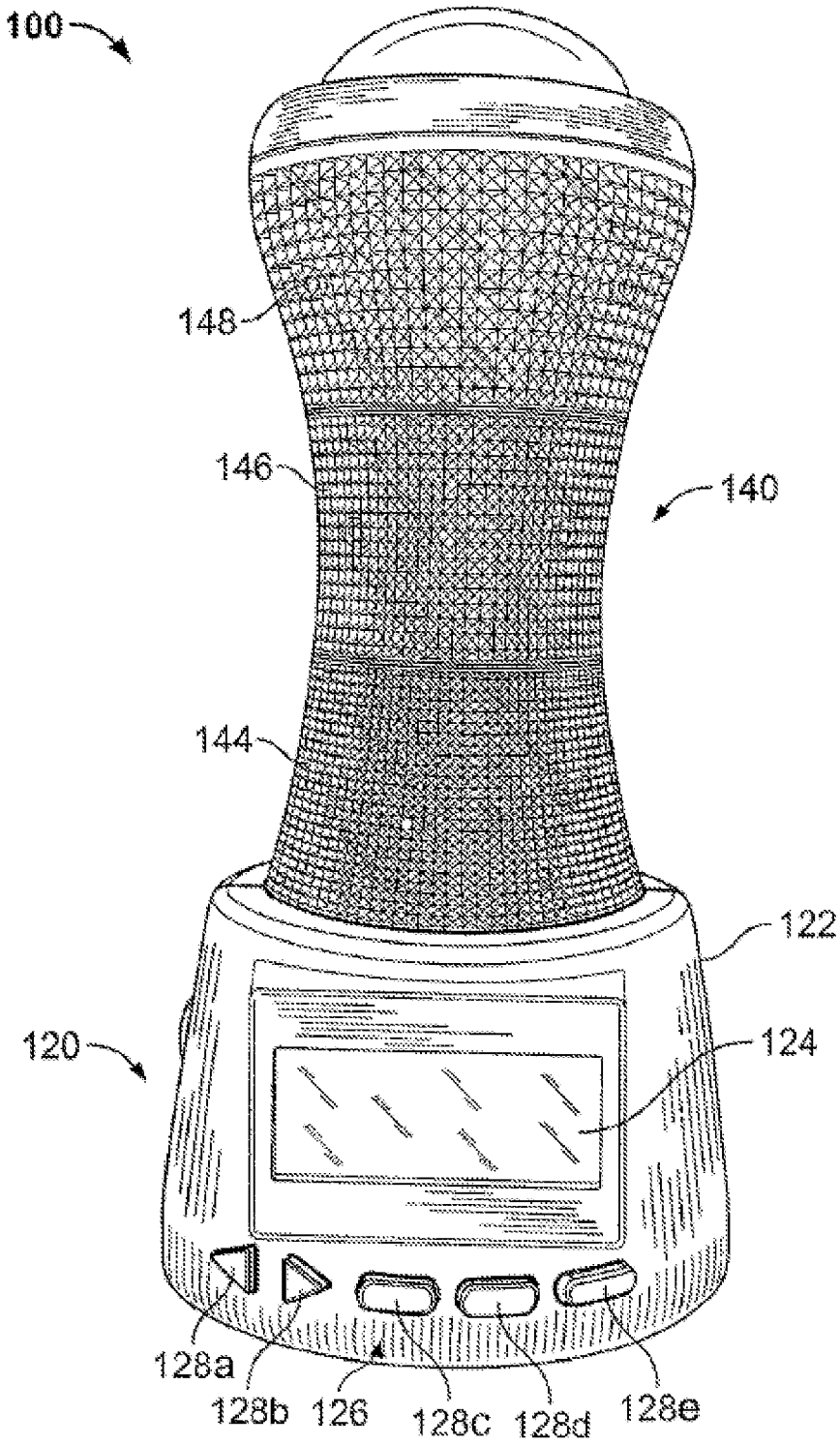
FIG. 1 illustrates a front elevation view of one exemplary embodiment of the time interval indicating device.
Figure 1A:
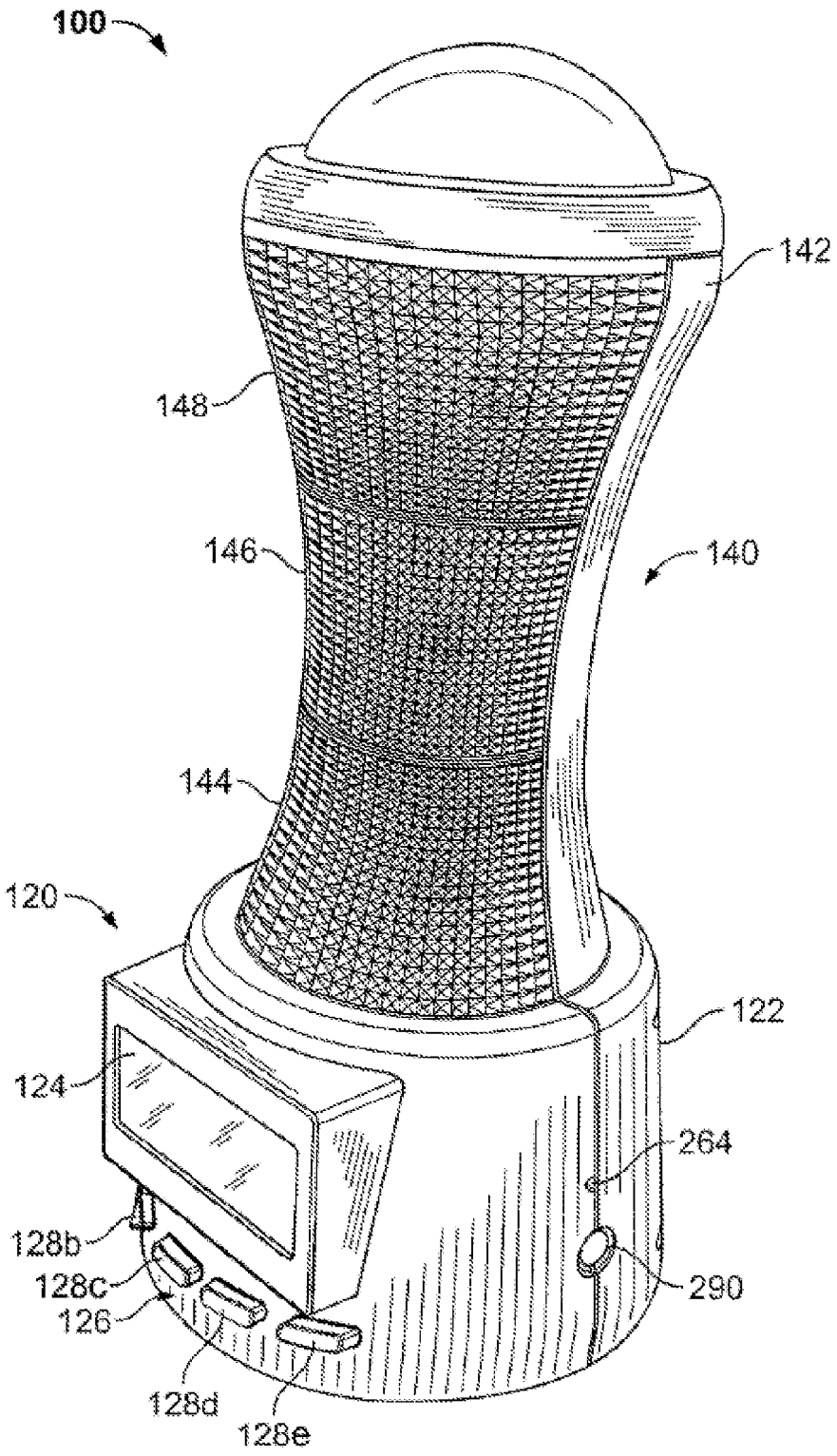
FIG. 1A illustrates a front perspective view of the embodiment of FIG. 1.
Figure 1B:
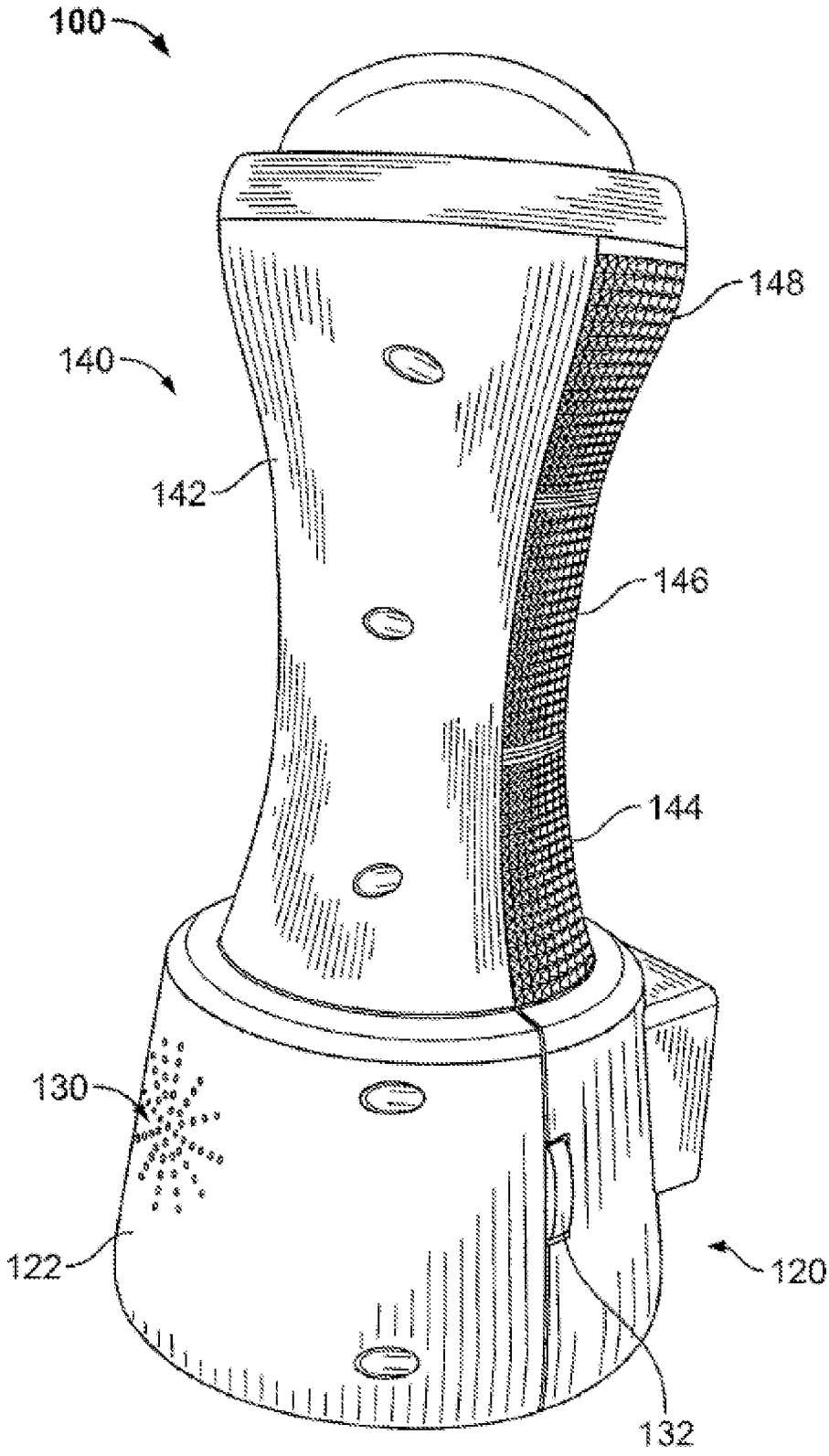
FIG. 1B illustrates a rear perspective view of the embodiment of FIG. 1.

Referring now to the figures, particularly FIGS. 1, 1A and 1B, an exemplary time interval indicating device is shown. As shown in FIG. 1, the exemplary time interval indicating device 100 has a generally hourglass-shaped housing including a base portion 120 and an upper, lighted portion 140. As shown, the base portion 120 has a generally truncated cone shape and the base portion housing 122 is molded or otherwise formed from a plastic material in two distinct halves (i.e., front and back), which are secured together by fasteners such as screws or the like. As shown in FIGS. 1A and 1B, the rear portion of the base housing 122 extends upward to form the back housing half 142 of the upper portion 140. As shown in FIGS. 1, 1A and 1B, the front half of the upper portion 140 is formed of a transparent or translucent material such as plastic or glass to permit light transmission therethrough. As shown, the front half of the upper portion 140 is segmented in three lighted sections 144, 146 and 148 in a vertical stacked lens arrangement above the base portion 120. Preferably, the three lighted sections 144, 146 and 148 are lenses of different colors, but alternatively they may be the same color or clear. Further, the lenses of sections 144-148 may be cut or otherwise formed to have a beveled surface or the like to provide a reflective or faceted lighting effect to facilitate viewing thereof. As discussed hereafter in further detail, one or more lights are disposed within the upper portion 140, particularly between the lenses of sections 144-148 and the rear housing half 142 such that the one or more lights is visible through the front half of the top portion 140, particularly through the lenses. The foregoing description of the device 100 is directed to an exemplary device and is not intended to be restrictive. To this end, the shape of the device as well as the arrangement and number of lighted sections 144-148 may be other suitable shapes, arrangements and number.

As can be appreciated from FIGS. 1A and 1B, the rear half of the upper portion 140 (i.e., back housing half 142) is substantially opaque such that the one or more lights disposed in the upper portion 140 are viewable about approximately 180° of the circumference of the upper portion 140. Other suitable angles less than or greater than 180° may be selected to focus or broaden the viewing angle of the device 100 about the vertical axis. In one exemplary embodiment, the sections 144-148 are colored to be green, yellow and red respectively, similar to the lights of a traffic stoplight, but other colors are also suitable. As will be appreciated from further discussion hereafter, the different colors of the lighted sections 144, 146, 148 advantageously provide a visual indication to a user of the general status of an activity being timed by the device 100. In one example the lighted sections 144-148 are illuminated sequentially and one at a time, the lighted green section 144 providing an indication that the activity being timed is in an initial phase, the lighted yellow section 146 indicating that the activity is in an intermediate stage, and the lighted red section 148 indicating that the activity is about to end or ending. In another exemplary embodiment, all sections may be initially lit, and the lights may be extinguished sequentially and one at a time to indicate the activity stage.

Referring now back to FIG. 1, the bottom portion 120 includes a housing 122 with a front and rear half, the front half including a user interface. As shown, the user interface includes a display 124 and keypad 126 with a plurality of buttons or keys 128. As discussed hereafter in further detail, the display 124 is a liquid crystal display (LCD) known in the art, but the display 124 may alternatively be a video display such as a thin film transistor (TFT), a CRT, plasma screen, or other known display devices. As best illustrated in FIG. 1, the keypad 126 includes a left arrow button 128*a*, a right arrow button 128*b*, a menu button 128*c*, a toggle or "start" button 128*d* and an enter button 128*e*. The user interface permits a user to configure or otherwise program the device 100 relative to an event or action including two or more sequential steps for facilitating timely completion thereof. The specific functionality of the buttons 128*a*-128*e* relative to programming and operating the device 100 will be discussed hereafter in further detail, but, in general, the buttons 128*a*-128*e* are used to program the device 100 with at least one time duration, and for associating each of the lighted sections 144, 146, 148 with a portion of the programmed time duration.

Figure 2:
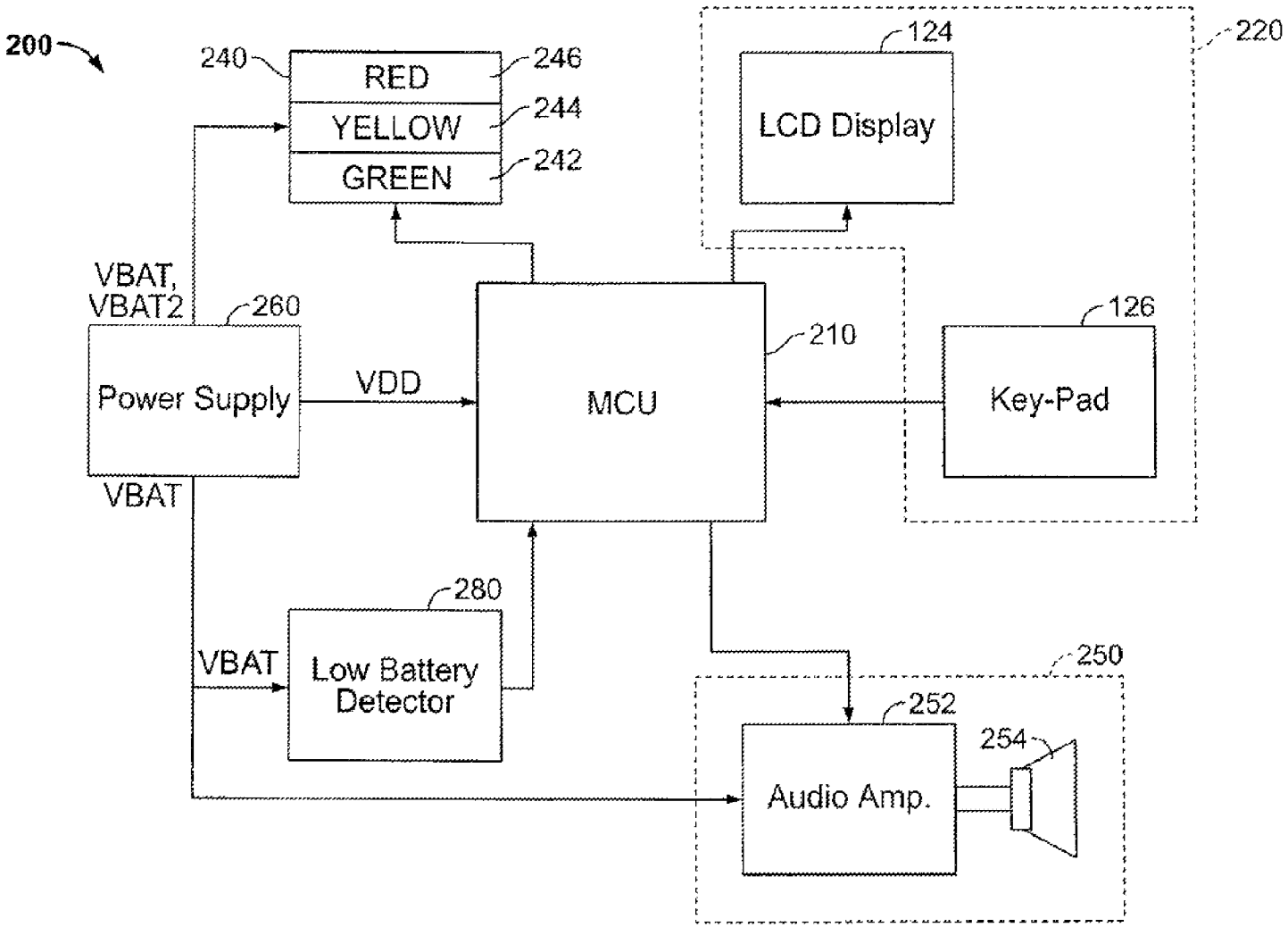
FIG. 2 illustrates a block diagram for the exemplary embodiment of FIGS. 1A and 1B.

As shown in FIG. 1A, the bottom housing 122 includes a hole for accessing a reset means 264 therein (e.g., a switch or button) for the purposes of resetting the device 100 in the instance that the device 100 may behave in an erratic manner. Upon pressing the reset means 264, the device 100 should return to its factory or default settings, and lose any previously programmed or user entered information. As shown in FIG. 2, the device 100 is powered by a power supply 260 that may be a DC source or an AC source such as a typical 120V outlet that is transformed to DC. In one exemplary embodiment the device 100 is powered by a main power source including one or more typical batteries (e.g., AA cells) and a backup power source such as one or more batteries (e.g., LR44 button cells) that may be similar or different from the foregoing main power source. The batteries may be disposed within the base portion 120 and more particularly within a battery chamber that may have a removably attached battery door in the base housing 122 for facilitating replacement of the batteries. In this manner the user of the device 100 may replace the batteries of the main power source without the device 100 losing its user-programmed settings. Further, if the device 100 is primarily powered with an AC source via an AC to DC adapter, the foregoing batteries permit portable and continued use of the device during momentary or extended outages of commercial (i.e., AC) power.

As shown in FIG. 1A, the base portion 120 may also include a power receptacle 290 for accepting the plug of an external power adapter such as an AC to DC adapter for powering the device 100 by a typical commercial power outlet or the like. The power adapter may provide for extending battery life and may facilitate extended-term or continual use of the device 100 as previously mentioned. As discussed hereafter, the device 100 may output one or more prerecorded audio signals such as sounds in association with the lighted portions 144-148. To this end, the lower housing 122 may include an opening 130 such as a grate or grill (FIG. 1B) that is positioned proximate to a speaker disposed within the lower housing 122 for allowing sounds to emanate through the housing 122. Further, the device 100 may be provided with a volume control 132 for increasing and decreasing the volume of sounds output from the speaker. As shown in FIG. 1B, the volume control is embodied by a thumb-wheel, however, other volume adjusting means may alternatively be provided. As is known, the thumb-wheel may be coupled to an adjustable resistor, rheostat, potentiometer, or the like for varying the speaker output volume.

Referring now to FIG. 2, a block diagram of the device's electrical system 200 is illustrated. As shown, the system 200 includes a controller 210 (MCU). The controller 210 may be any type of logic device known in the art such as a microcontroller, microprocessor, programmable logic controller (PLC) or the like, that is operable to receive an input and affect one or more outputs relative to the received input. The controller 210 is powered by power supply 260, which may include one or more power sources (e.g., batteries of different sizes and/or voltages). For example, in one exemplary embodiment the power supply 260 includes a 6 volt power source (VBAT, VBAT2) for energizing various subsystems such as the light module 240, the audio module 250 and user interface display 124, and a 3.6 volt source (VDD) for powering the controller 210. The controller 210 receives communications such as inputs from keypad 126 and outputs signals, such as, for example, a control signal to drive the display 124 relative to keypad inputs. Additionally, the controller 210 is operatively coupled to control the light module 240 for the purposes of illuminating and de-energizing the various light sections 144-148 (FIG. 1) via light sources 242-246, respectively. Each of the light sources 242-246 may comprise one or more lights such as light-emitting diodes (LEDs). The light sources 242-246 may alternatively comprise incandescent or other lights or combination of lights known in the art. In another embodiment, the light section 240 may provide one color changing light such as a multicolor LED known in the art. The controller 210 may be operative to drive light sources 242-246 to achieve various lighting effects such as flashing, strobing and the like, but minimally the controller 210 should be operable to drive the light module 240 such that only one light source 242-246 is illuminated at any one time. Moreover, if each light source 242-246 comprises more than one or a plurality of lights (e.g., LEDs) to provide reliability (i.e., through redundancy) and visibility, the lights of each light source 242-246 act together in communication with the controller 210 to turn on and off as a single light. Alternatively, the lights of light source 242-246 could act one by one.

As previously mentioned, the device 100 may output various audio signals coincidentally, sequentially, or otherwise in association with the illumination of lights 242-246. Controller 210 may include a memory of one or more pre-recorded sounds and the controller 210 may be operative to drive an audio amplifier for speech or melody synthesis. For example, the controller 210 may be operative to drive audio amplifier 252 with a pulse width modulation (PWM) signal. Thereafter, the audio amplifier 252 processes and amplifies the PWM signal for outputting a sound through speaker 254. Additionally, as known in the art, the system may include a microphone or means for coupling an external microphone to the controller 210 so that the user may record a sound to be output from the audio module 250 during operation of the device 100. For example, a teacher may record his or her voice saying "time to clean up" or the like for an ending sound signal. Although the light module 240 and the audio module 250 provide sensory indicators (i.e., outputs or signals) to the one or more users of the device 100, other sensory indicators may be provided in addition or alternative to the modules 240, 250, such as, for example tactile and olfactory indicators. As known in the art, a tactile indicating means such as a vibrating motor, liquid emitting device or the like may couple with the controller 210 for providing a user with a tactile indication. Further, an olfactory indicating means such as an odor or fragrance emitting device may couple with the controller 210 for providing a user with a scent indication.

As shown in FIG. 2, the system 200 may include a low battery detector 280, which provides a voltage detector to detect a low voltage event at the power supply 260. The low battery detector 280 may periodically monitor the power supply 260 to determine if the power supply voltage is lower than a pre-determined voltage level. Thereafter, the low battery detector 280 may communicate with the controller 210 to provide a low battery indication or warning to the user of the device 100. In receipt of a communication or signal from the detector 280, the controller 210 may output a signal to the display 124 or speaker 254 so that the user is provided with a visual or audible indication or warning that the batteries are depleted. Additionally, the controller 210 may, upon receipt of a signal from the detector 280, shut down one or more subsystems (i.e., the light module 240, or the audio module 250) of system 200, or cause the controller 210 and system 200 to enter a standby state to reduce current consumption from the power supply 260.

Figure 3A:
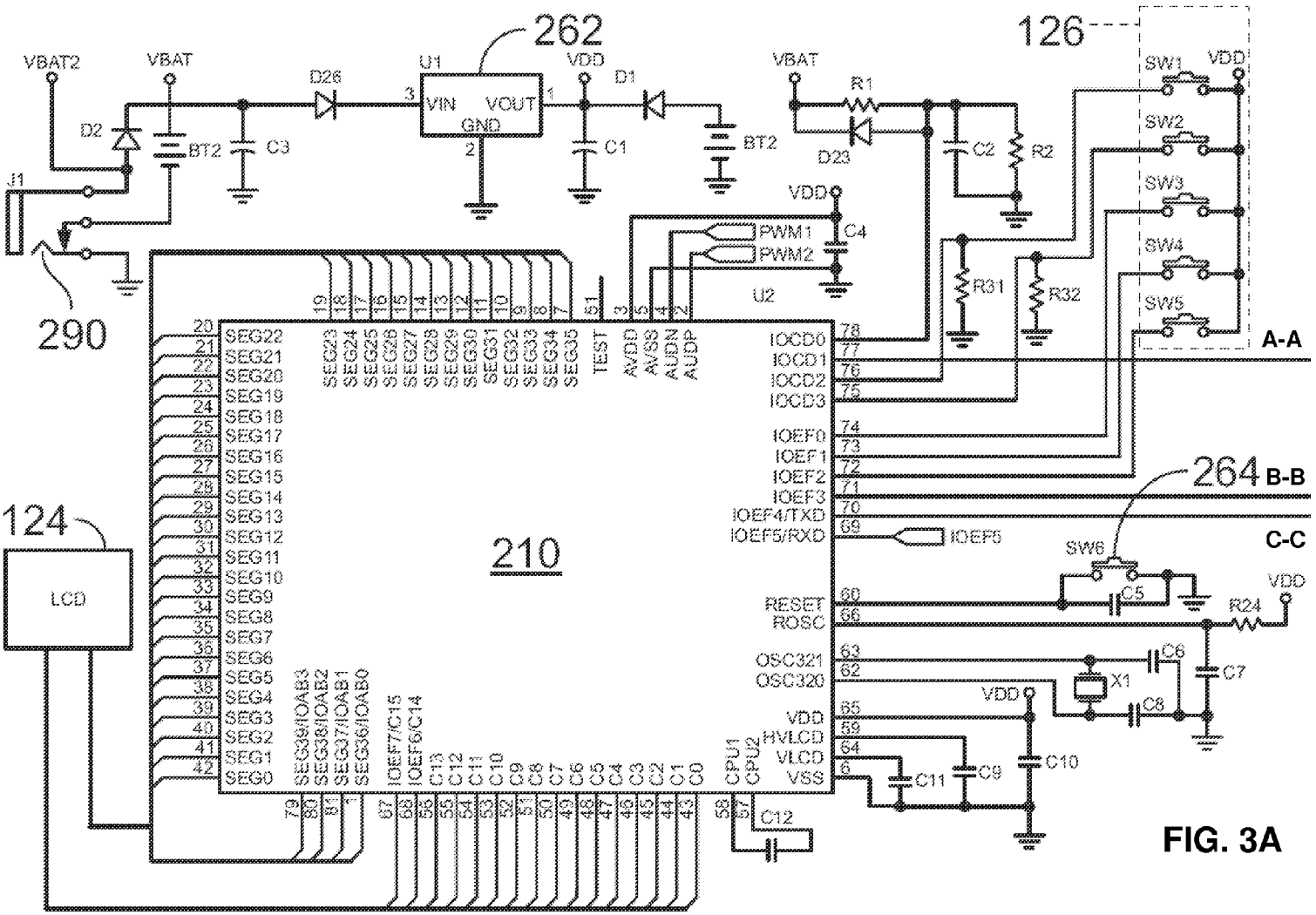
FIGS. 3A and 3B illustrate an exemplary electrical schematic diagram in accordance with the block diagram of FIG. 2.
Figure 3B:
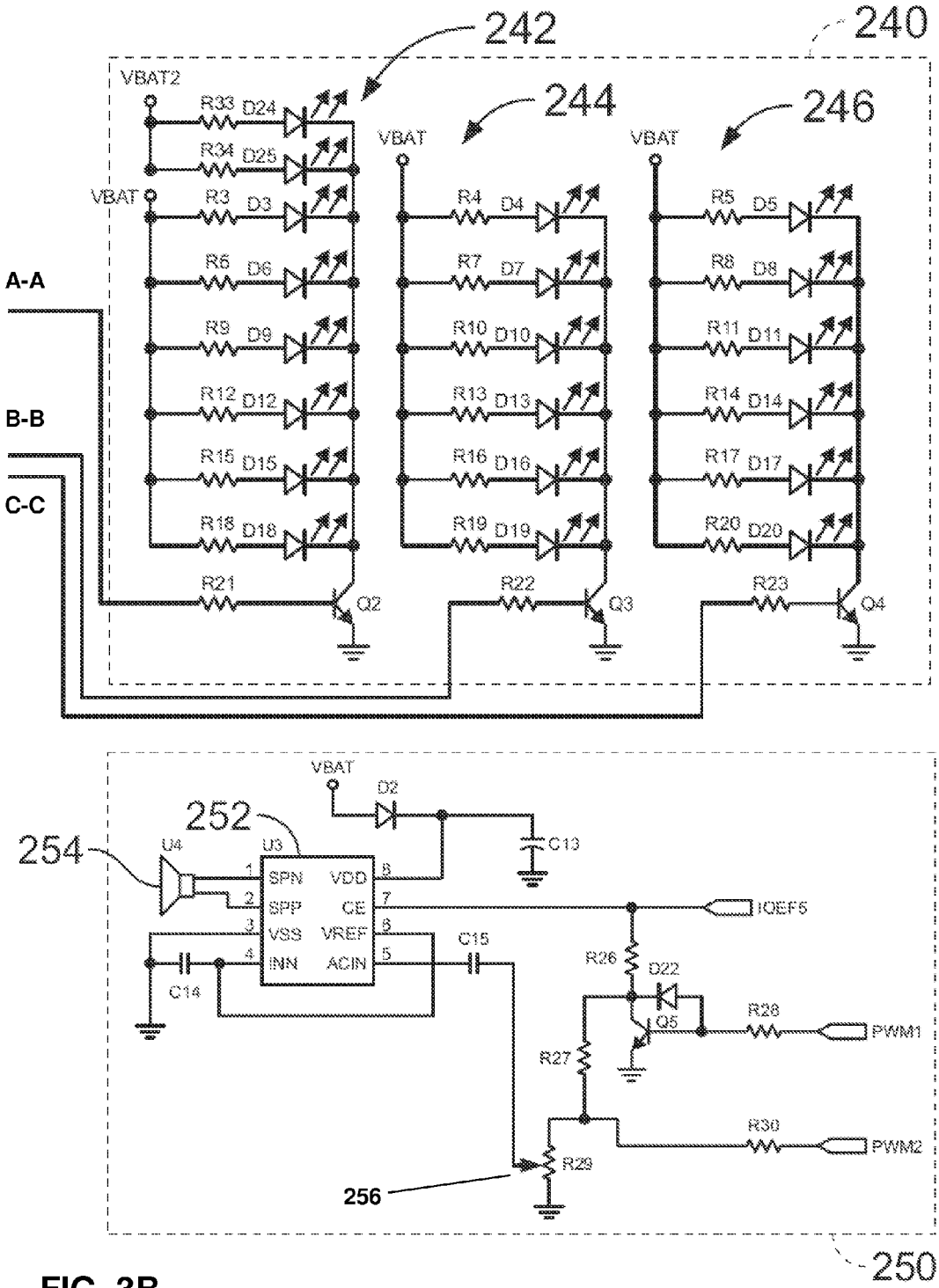

Referring now to FIGS. 3A and 3B, an electrical schematic diagram in accordance with the system 200 of FIG. 2 is described. As shown, the controller 210 may be a single chip microprocessor containing RAM, ROM, input outputs (I/Os), and the like known in the art. One exemplary controller 210 is the SPL61A available from SunPlus Technology Company. The SPL61A is an 8-bit CMOS single chip microprocessor including RAM, ROM, I/Os, an 8-bit PWM audio output, and a display controller/driver for a liquid crystal display (LCD). The SPL61A is operative to control a LCD display including up to 40 segments and 16 commons, with a maximum of 640. To this end, the controller 210 is operatively coupled with the display 124, which is a 40 by 15 LCD panel that is known in the art. As shown, keypad 126 includes 5 switches SW1 through SW5 embodying buttons or keys 128*a* through 128*e* of FIG. 1. The switches are connected to input/output pins of the controller 210 for the purpose of selecting modes of operation, entering information, and associating lights and/or sounds with time intervals or various portions of a duration of time for timing by the controller 210 in communication with an oscillator 266. As shown, the oscillator 266 is an externally-coupled crystal oscillator having a frequency of 32768 Hz for clock-type timing, but the oscillator 266 may alternatively be integral with the controller 210.

Figure 4:
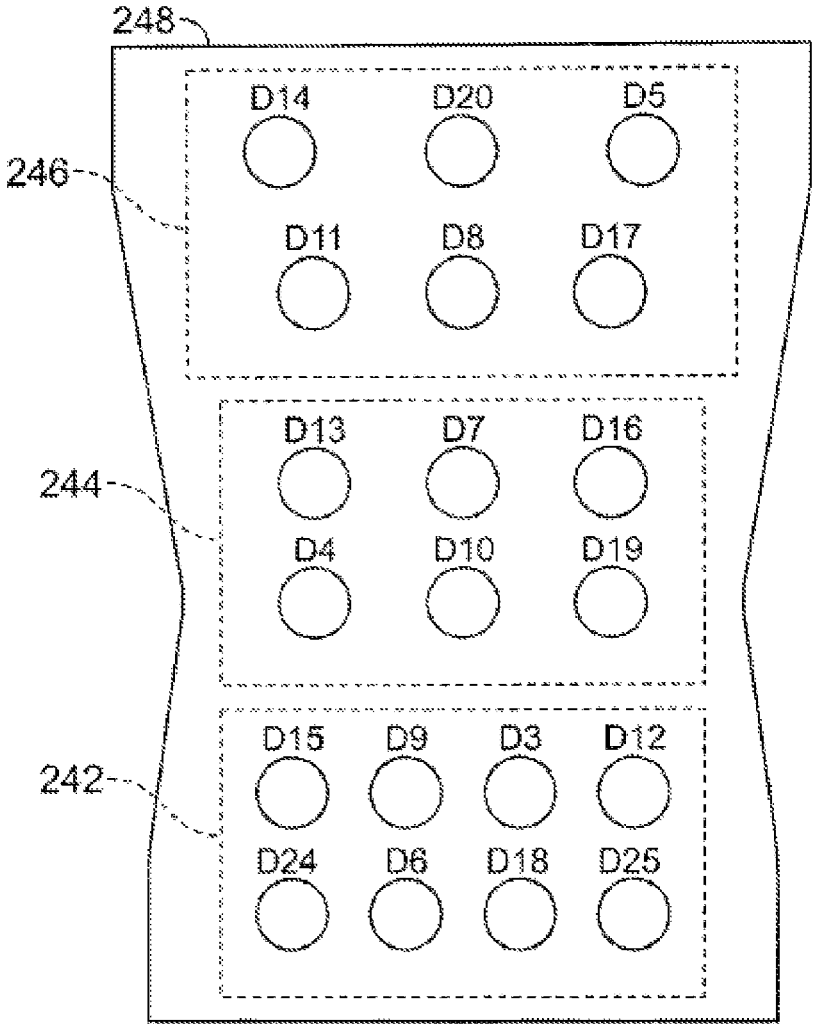
FIG. 4 illustrates an exemplary arrangement of LEDs in accordance with the electrical schematic diagram of FIGS. 3A and 3B.

As shown in FIGS. 3A and 3B, the light module 240 includes a plurality of light-emitting diodes arranged in three groupings 242, 244, 246. The LED groupings 242-246 are connected to the power supply 260 (VBAT, VBAT2) and operatively coupled to the controller 210 through transistors Q2, Q3 and Q4 for illumination. The first LED grouping 242 includes eight LEDs, whereas the second and third LED groupings 244 and 246 include six LEDs, but other quantities and arrangements of LEDs may be provided. Referring now to FIG. 4, the LED groupings 242-246 are illustrated as arranged in a generally vertical, stacked formation in accordance with the translucent front housing sections 144-148 as shown in FIGS. 1 and 1A. As previously mentioned, the translucent front half of the upper portion 140 may be multicolored, and therefore the plurality of LEDs (FIGS. 3A, 3B and 4) may be white or colored LEDs known in the art. In one alternative embodiment, the plurality of LEDs may be substituted with one or more multicolor or color-changing LEDs known in the art. As shown in FIG. 4, the LEDs 242-246 may be attached or coupled to a circuit board 248 along with their associated resistors and transistors (FIGS. 3A and 3B). In one exemplary embodiment the LED circuit board 248 is disposed in the upper section 140 in a generally vertical arrangement behind the translucent lens sections 144-148.

As shown in FIGS. 3A and 3B, the audio module 250 includes an audio amplifier 252 and a speaker 254 connected to the audio amplifier 252 for producing sounds such as sound effects, simulated speech, music, and the like. One exemplary audio amplifier 252 is the SPY0030A available from the SunPlus Technology Company, but other audio amplifiers known in the art may substituted as appropriate. Further, the speaker 254 may be a toy-grade speaker such as a 32 ohm, 40 millimeter speaker known in the art. Additionally, the audio module 250 may include a volume adjustment 256 for increasing or decreasing the volume as desired by the user. One exemplary volume adjustment 256 is illustrated as a variable resistor, however other volume adjusting means such as rheostats, potentiometers and the like may be used. As previously mentioned, the system 200 (FIG. 2) may include an internal power supply 260, or may alternatively be powered through an external adapter coupled with a typical 120 volt outlet. To that end, as shown in FIGS. 3A and 3B, an AC adapter outlet 290 is provided for powering the device 100 from an external source. In addition, a voltage regulator 262 is provided for maintaining a consistent voltage to the controller 210. As previously mentioned, the device 100 may include a reset switch 264 for returning the device 100 to its factory settings, such as if the device 100 were to malfunction or behave erratically. By pressing the reset switch 264, the controller 210 is momentarily reset by shorting the reset pin of the controller 210 to ground potential as shown in FIGS. 3A and 3B. The electrical schematic diagram of FIGS. 3A and 3B and LED arrangement illustrated in FIG. 4 are provided as illustrative of an exemplary embodiment and are not to be deemed as limiting the device 100 to any particular arrangement of electrical components or interconnection thereof.

Hereafter, the operation, programming and method of use for the device 100 is described. In one exemplary embodiment, the device 100 includes one or more programming modes and one or more time-indicating modes relative to the programming modes. In a first programming mode hereinafter referred to as the "automatic" programming mode, the exemplary device 100 receives a user-input total duration of time for an activity and automatically subdivides that total duration of time into subintervals in accordance with pre-programmed or otherwise established percentages, ratios or fractions. In an "automatic" operating mode that is associated with the "automatic" programming mode, the device 100 times an activity having the user-input total duration of time, which was entered in the "automatic" programming mode, so that the activity is timed in a subdivided manner with multiple intervals making up the total duration of time. In a second programming mode hereinafter referred to as the "manual" programming mode, the exemplary device 100 receives multiple user-input time intervals that define the total time duration or length of time of an activity as the sum of the user-input time intervals. In a "manual" operating mode that is associated with the "manual" programming mode, the device 100 times an activity having the user-input intervals of time, which were entered in the "manual" programming mode, so that the activity is timed in a subdivided manner with the multiple intervals making up the total duration of time for the activity. The device 100 may also include a clock setting mode that may be used to program the controller 210 with the time of day such that the display 124 provides an hour, minute and second (HMS) time so that the device 100 may be used as a clock when it is not being used for timing an activity.

As briefly described, the device 100 may be programmed and operated to provide a sensory indication of the progression of the time duration for an activity having a pre-determined or known total duration. The activity may further include two or more sequential events or steps that subdivide the total duration of the activity. Thus, the device 100 may operatively indicate to an activity participant his or her progress relative to the total length of the activity, and assist in timely completion of the activity by indicating transitions from one step to another. In one example, the device 100 may be programmed for use in a classroom setting to provide assistance to students working as a team in a small group activity to indicate the various stages of the activity (e.g., drafting a hypothesis, experimental investigation, and drafting a conclusion). In another example, the device 100 could be used by a teacher as a way of gently or progressively reminding the students of when it is time to clean up. In one instance, if an activity is to last twenty minutes a green light may be programmed to illuminate for sixteen minutes, a yellow light may be programmed to illuminate for three minutes signifying time to clean up and a red light may be programmed to illuminate for one minute to indicate the end of the activity. Other types of exemplary uses would include baking, where the individual might want to check a cake at several times before the end (e.g., five and two minutes before the end) of the expected baking time due to temperature fluctuations in the oven, or in a laboratory experiment where the individual might want to change the reaction temperature after a certain period of time and then later add an ingredient or check the temperature after another interval of time.

In the "manual" and "automatic" programming modes a user may program or otherwise establish the duration of an activity by incrementing or decrementing a time setting by using buttons 128*a* and 128*b*. In the "automatic" programming mode of the exemplary embodiment, a user may input a total length or duration of time for an activity and the controller will subdivide that total length of time into a predetermined number of intervals of time to correspond with the number of light sections (e.g., three in FIG. 1). With reference to FIG. 1, in one example, the lighted sections 144, 146 and 148 are each associated with one time interval, the sum of which is the user-input total length of time. For example, section 144 is associated with 80% of the total duration and initially illuminated at the start of the activity, section 146 is associated with 15% of the total duration and illuminated subsequent to section 144, and section 148 is associated with 5% of the total duration and illuminated subsequent to section 146. Other ratios, percentages, fractions may be established or selected by the user, by presetting the controller 210 such that the other percentages, ratios or fractions are selectable via user interface 220. Additionally, the sequence of illuminating the sections 144-148 may be preset or alternatively established, programmed or otherwise selected by the user. The device 100 may provide the bottom-up illumination as previously described, a top-down illumination (e.g., sections 148, 146 and 144 in succession), or other sequences as desired. Alternatively, the device 100 may initially turn on all sections 144-148 and provide for sequential extinguishing (e.g., top-down, bottom-up or other) of the sections 144-148.

In the "manual" programming mode, the user may establish time intervals for each section 144, 146 and 148 independently of each other, thereby defining the total time duration or length of time of an activity as the sum of the time intervals. For example, the user may program a twenty minute duration of time for each of the three lighted sections 144-148 to provide an overall activity length of time or duration equaling one hour. Such a "manual" programming mode may generally be used when the individual programming the device 100 for timing an activity requires more flexibility and customizability than the "automatic" programming mode provides.

Additionally, in the foregoing "automatic" and "manual" programming modes, the user may also associate the output of one or more audio signals or sounds from the audio section 250 with one or more of the lighted sections 144-148, or with one or more of the transitions therebetween. In one embodiment, the user may associate a sound with one or more portions of each time interval (i.e., lighted sections 144-148), so that the sound is emitted, for example, at the start or end of each interval. Further, the user may assign a different sound for each lighted section to enable the user to better distinguish the beginning and/or end of each interval. Moreover, the active (i.e., illuminated) section 144-148 may flash one or more times (e.g., three times) or strobe at the end of its associated time interval to indicate an imminent transition to the subsequent time interval. For example, the green section may flash before the yellow section illuminates, the yellow section may flash before the red section illuminates and the red section flashes before the red section extinguishes (i.e., turns off). The flashing of the active section may generally coincide with the sound output from the audio section 250. Particularly, in the foregoing example with the flashing sections, the user may program sounds at the beginning of the green and yellow sections and at the end of the red section and the device 100 may automatically output a sound at the transition from the yellow section to the red section to provide a gentle warning.

While programming the device 100 with the intervals, the controller 210 may present the user with one or more queries via the display 124 for associating a sound with each of the intervals. If the user responds affirmatively to a query, the controller may then present a list of pre-recorded sounds via the display 124 for the user's selection. For example, the user may scroll through the pre-recorded sound choices using arrow buttons 128*a* and 128*b* and select a sound of interest with the enter button 128*e*. If the user responds negatively to a query for associating a sound with an interval, the controller 210 may present the user with the option of associating a sound with a subsequent or different interval until the controller 210 has presented the user with the option for associating a sound with each of the intervals. Once associated with an interval, the selected sound is emitted at some time within the associated interval. Having associated sounds with one or more portions of each interval, a user of the device 100 may assess his or her progress during the duration of the event through the auditory or visual signal or cues output by the device 100. The device 100 may thereby provide assistance to a group of individuals with differing sensory impairments, such as a combination of visually and hearing-impaired individuals. This feature may also prove useful for practical everyday tasks, such as working in the vicinity of a timed event requiring multi-tasking (e.g., baking a cake, performing a laboratory experiment) where the individual may either not see or not hear the alarm. Other practical uses for the device 100 include the use with small children who have time-limited activities like TV watching. Since young children are likely to consider the changing colors and the sounds as a form of reward, such visual and audible cues alone or in combination would be helpful in communicating the consequence of the elapse of time. By providing both visual and audible cues of the progression of time, the device 100 may be used for a variety of functions.

After having programmed the device 100 via one of the "automatic" and "manual" programming modes, the user may select a time-indicating (i.e., operating) mode corresponding to the associated programming mode. By pressing the menu button 128*c* and toggling between the time-indicating modes (i.e., the "automatic" or "manual" operating mode) with arrow buttons 128*a* and 128*b* the user may then select the operating mode of interest with enter button 128*e*. For example, if a user previously programmed the device 100 with a time duration via the "automatic" programming mode, the user may then subsequently time an activity lasting that programmed time duration by selecting the "automatic" operating mode. Conversely, if a user previously programmed the device 100 with a number of time intervals via the "manual" programming mode, the user may then subsequently time an activity lasting the sum of the programmed time intervals by selecting the "manual" operating mode. The time-indicating modes provide for timing an activity and indicating the progression of various stages (i.e., the intervals) of the activity by outputting sensory (e.g., visual, audible, etc.) cues.

The user selects one of the two time-indicating (i.e., operating) modes as appropriate or desired for a particular activity, and thereafter the display may show a prompt such as "START?" along with the pre-programmed duration of time for the activity. If the user wants to change the time duration or other user-selected options such as sounds or otherwise does not wish to activate the selected operating mode, the user may press the menu button 128*c* or simply let the controller 210 time out and return the display 124 to a default screen (e.g., the time of day clock) due to lack of input within a predetermined time input window (e.g., 10 seconds). If the user does wish to activate the selected operating mode, the user may press the toggle button 128*d*, which initializes the controller 210 to start a decremental time counter therein. In association with the initialization of the decremental time counter, the controller 210 initially illuminates the first lighted section 144 via LED grouping 242 to indicate the initial interval or portion of the activity. The controller 210 may also output a sound via sound section 250 if the user previously associated a sound with the first time interval during the programming mode.

Further, during the decremental timing operation of the controller 210, the controller 210 communicates with the display 124 to show a countdown timer (i.e., a continuously decrementing time display) relative to either the total time remaining in the event duration, or the time remaining in the active interval (i.e., the illuminated section 144, 146 or 148). Further, the user may operatively toggle the countdown timer display between the total time remaining in the duration (i.e., the time remaining in the active interval added to the durations of one or more subsequent intervals), or the time remaining in the active interval to further assist the user in assessing their progress throughout the event. For example, in the exemplary embodiment of the device 100, the countdown (decremental) timer is displayed on LCD panel 124 and may be toggled between the total time remaining for the activity and the time remaining in the active interval by pressing toggle button 128*d*. In addition, the controller 210 may provide for pausing the decremental timer and the countdown timer display by pressing one or more of the buttons 128*a-e* (e.g., pressing arrow buttons 128*a* and 128*b* together), such as during a temporary, unplanned interruption of the activity. For example, an interruption may be needed to provide further instructions, clarification, answer questions or the like to participants of the activity. After pausing the decremental timer and the countdown timer display, the timer and display may be re-started after the interruption by pressing one or more of the buttons 128*a-e* (e.g., toggle button 128*d*).

After the decremental timer has determined that the active interval has passed or expired, the controller 210 drives or otherwise actuates the appropriate subsequent LED grouping or groupings of the light section 240, and the audio section 250 for providing an indication of the transition between intervals and the state of the activity (e.g., start, middle, end). At the end of the activity duration, the device 100 may indicate the end of the total length of time such as by flashing the lights, strobing the lights, outputting one or more sounds, or any combination thereof such that the device 100 thereby provides a clear visual indication that the activity or interval is over.

Although the device 100 is mentioned above to be useful in a classroom setting for test taking or other group activities, the device 100 also has many other uses and applications. As previously mentioned, the device 100 may be used in a laboratory setting for providing sensory cues (e.g., visual, audible, etc.) to a particular step in an experiment or chemical reaction. Further, the changes in color from one region to another may indicate to a technician to add an ingredient, change the temperature, or some other operation. Moreover, the different colors of the lighted sections 144 through 148 may signify different activities. For example, green could mean monitor and experiment at a lab bench, yellow could mean stop monitoring the experiment and do desk work and red could mean stop desk work and hold a team meeting. In other exemplary uses, the device 100 may be used to provide a stepped or incremental warning that an event or activity is almost complete. The device 100 may also be used for limiting TV time for children, or progressive warnings that the end of the children's TV time is nearing. Additionally, the device 100 may be for activities such as baking, giving a speech, meetings, oral arguments in a courtroom and other activities having pre-determined lengths of time.

Figure 5:
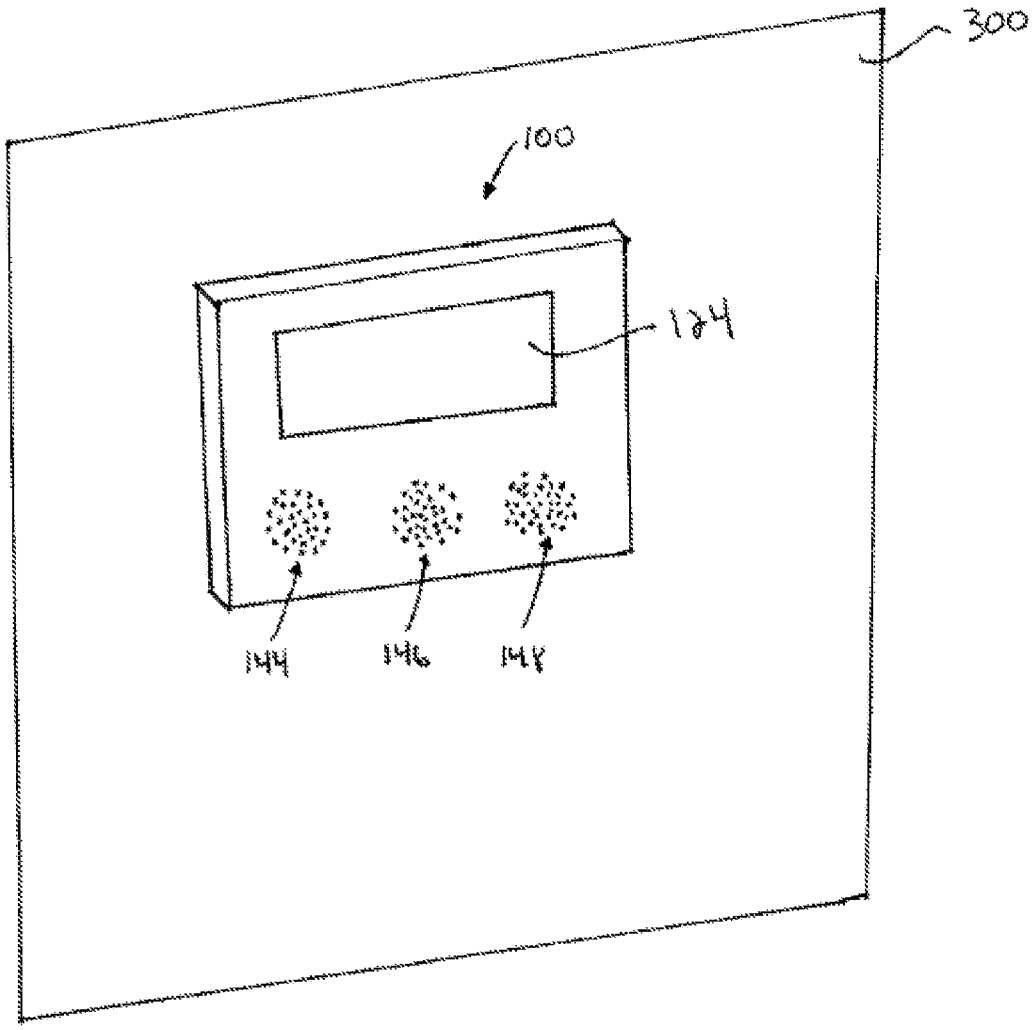
FIG. 5 illustrates a front elevation view of another exemplary embodiment of the time interval indicating device.

With reference to FIG. 5, other embodiments of the device may provide a large panel-type display, which may be hung on a wall 300 or otherwise supported, for viewing by a plurality of individuals. Such an embodiment may include a plurality of lights 144, 146, 148 such as LEDs and a large LCD display 124 that is easily viewable at a distance. The lights 144, 146, 148 may be arranged in a ring-like orientation and include white (e.g., super-white LEDs) or other colored lights that will flash, strobe, or otherwise attract the attention of the activity participants. Another embodiment may have a substantially flat housing and include a transparent portion for adapting the device for use with or cooperating with an overhead projector or the like. To this end the device may allow an individual to project a presentation, learning aid or other materials such as printed materials, for an activity on a screen by way of the transparent section to a plurality of individuals and also provide a visual time indication of to the individuals viewing the projection. Such a device may prove useful in a classroom, meeting or presentation setting.

Several embodiments of this invention are described. Variations of those embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A device for indicating a plurality of time intervals within a period of time, the device comprising:

an indicator for indicating which of the plurality of time intervals is pending;

a user interface including an incremental input, a decremental input, and an enter input for selecting whether the device operates in a first device mode or a second device mode, for inputting the period of time when the device operates in the first device mode, and for inputting a duration of each of the plurality of time intervals when the device operates in a second device mode;

an electronic display distinct from the indicator and responsive to user interface inputs; and a controller programmed to receive inputs from the user interface and to provide outputs to the electronic display and the indicator, wherein in the first device mode the controller subdivides the period of time into the plurality of time intervals, wherein in the second device mode the controller sums the durations of each of the plurality of time intervals to calculate the period of time.

2. The device of claim 1, wherein the incremental input and the decremental input toggle the device between the first device mode and the second device mode, and wherein the enter input selects whether the device operates in the first device mode or the second device mode.

3. The device of claim 2, wherein the display automatically updates during toggling of the device to indicate whether operation of the enter input will select the first device mode or the second device mode.

4. The device of claim 1, wherein the electronic display prompts a user to select each of the following: a) whether the device operates in the first device mode or the second device mode, b) the period of time when the device operates in the first device mode, and c) the duration for each of the plurality of time intervals when the device operates in the second device mode.

5. The device of claim 1, wherein the controller determines and instructs the user interface to display appropriate requests for user input depending upon whether the device is selected to operate in the first device mode or the second device mode.

6. The device of claim 1, wherein the device includes a programming mode during which the incremental and decremental inputs are operable to set the period of time while the device is in the first device mode and to set the durations of each of the plurality of time intervals while the device is in the second device mode.

7. The device of claim 1, wherein the user interface includes exactly one incremental input and exactly one decremental input.

* * * * *